US008172222B2

(12) United States Patent
Yoda et al.

(10) Patent No.: US 8,172,222 B2
(45) Date of Patent: May 8, 2012

(54) STACKING MECHANISM AND RECORDING APPARATUS WITH LOCKING MECHANISM FOR PAPER OUTPUT TRAY

(75) Inventors: Hiroyuki Yoda, Shiojiri (JP); Shigeto Omatsu, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/914,686

(22) Filed: Oct. 28, 2010

(65) Prior Publication Data

US 2011/0101601 A1 May 5, 2011

(30) Foreign Application Priority Data

Oct. 29, 2009 (JP) ..... 2009-248934

(51) Int. Cl.
*B65H 1/00* (2006.01)

(52) U.S. Cl. ..... 271/162; 399/405; 400/646

(58) Field of Classification Search ..... 271/162; 399/405; 400/646
See application file for complete search history.

(56) References Cited

U.S. PATENT DOCUMENTS 7,597,317 B2 * 10/2009 Okuda ..... 271/162

FOREIGN PATENT DOCUMENTS

JP 2005-348339 12/2005

* cited by examiner

*Primary Examiner* — Gerald McClain
(74) *Attorney, Agent, or Firm* — Workman Nydegger

(57) ABSTRACT

Provided is a stacking mechanism that includes a paper feed tray including a paper inlet through which a recording medium to undergo a recording process is to be supplied; a paper output tray on which the recording medium that has undergone the recording process and been transported is to be stacked, the paper output tray being superposed on the paper feed tray; a pivotal shaft that allows the paper output tray to pivot with respect to the paper feed tray so as to expose the paper inlet of the paper feed tray; and a lock mechanism that locks the paper output tray displaced about the pivotal shaft, at a predetermined position.

3 Claims, 10 Drawing Sheets

STACKING MECHANISM AND RECORDING APPARATUS WITH LOCKING MECHANISM FOR PAPER OUTPUT TRAY

BACKGROUND

1. Technical Field

The present invention relates to a stacking mechanism and a recording apparatus.

2. Related Art

Recording apparatuses developed to date that record data on a recording medium include those of a type that execute ink jet printing with a recording head, and of another type that form a static latent image on a photosensitive material and transfer a toner image to the recording medium, to thereby record the image thereon. The latter can be found, for example, in JP-A-2005-348339.

Now, the recording apparatus includes a stacking mechanism in which the recording medium, typically paper in sheet form, is to be stacked, and a user takes out the paper that has undergone the printing process from a paper output tray of the stacking mechanism, and refills the paper in a paper feed tray of the stacking mechanism.

In some of lately developed home-use printers, the paper output tray is superposed on the paper feed tray inside the outlet of the paper, in response to the requirement for reduction in size of the printer. To refill the paper in the printer thus designed, the user has to draw out the paper feed tray through the outlet.

The structure in which the paper output tray is superposed on the paper feed tray has, however, a drawback that the accessibility to a pull portion of the paper feed tray is degraded. This leads to inconvenience in refilling the paper, and a solution therefor is being sought.

SUMMARY

An advantage of some aspects of the invention is that the invention provides a stacking mechanism and a recording apparatus that allow improvement of work efficiency in refilling a recording medium.

According to an aspect of the invention, a stacking mechanism is provided that includes a paper feed tray and a paper output tray superposed thereon inside an outlet through which a recording medium is to be taken out, wherein the paper output tray includes a pivotal shaft, located on an upstream side of the outlet in a direction in which the recording medium is taken out, that allows angular displacement of the paper output tray with respect to a paper inlet of the paper feed tray. The stacking mechanism further includes a lock mechanism that locks the paper output tray displaced about the pivotal shaft, at a predetermined angle.

In the stacking mechanism thus configured, pivoting the paper output tray about the pivotal shaft located on the upstream side the outlet provides an opening between the paper feed tray and the paper output tray at the outlet thereby enlarging the paper inlet. The paper output tray can also be retained at the predetermined angle. Such a configuration facilitates access to the pull portion of the paper feed tray, and also allows refilling of the recording medium without drawing out the paper feed tray.

In another aspect of the invention, the stacking mechanism may include a drawing mechanism that allows drawing out of the paper output tray through the outlet in the direction in which the recording medium is taken out, and the lock mechanism may lock the paper output tray drawn out, at the predetermined angle.

Locking the paper output tray set in an initial position but displaced at the predetermined angle would, for example, restrict the area for receiving the discharged paper, and hence if the recording medium that has undergone the recording process were discharged in this state the recording medium might fail to be properly stacked, resulting in a paper jam. In an aspect of the invention, therefore, the paper output tray is locked only when drawn out through the outlet, to thereby avoid the foregoing drawback.

In still another aspect of the invention, the paper output tray may include a projection provided on a downstream side of the pivotal shaft in the direction in which the recording medium is taken out. The drawing mechanism may include a first guide groove that guides the pivotal shaft and a second guide groove that guides the projection. The first guide groove may be provided between an initial shaft position where the pivotal shaft is located when the paper output tray is in the initial position, and a distal shaft position on the downstream side in the direction in which the recording medium is taken out, where the pivotal shaft is located when the paper output tray is drawn out. The second guide groove may include a first pivotal groove that pivotally guides the projection between a first initial projection position where the projection is located when the pivotal shaft is at the initial shaft position and a second initial projection position located above the first initial projection position, a second pivotal groove that pivotally guides the projection between the first distal projection position where the projection is located when the pivotal shaft is at the distal shaft position and a second distal projection position located above the first distal projection position, and a connection groove extending in the direction in which the recording medium is taken out so as to connect the first pivotal groove and the second pivotal groove.

Such a configuration allows the pivotal shaft to be guided along the first guide groove and the projection to be guided along the second guide groove, thereby drawing out the paper output tray through the outlet. When the pivotal shaft is at the initial shaft position, the projection can pivotally move along the first pivotal groove between the first initial projection position and the second initial projection position. Likewise, when the pivotal shaft is at the distal shaft position, the projection can pivotally move along the second pivotal groove between the first distal projection position and the second distal projection position.

In still another aspect of the invention, the lock mechanism may be provided in the second pivotal groove.

Such a configuration allows the paper output tray drawn out through the outlet to be locked at a predetermined angle.

In still another aspect of the invention, the lock mechanism may be located at a position corresponding to the second distal projection position.

Such a configuration allows the paper output tray to be locked at the second distal projection position at a higher position than the first distal projection position.

In still another aspect of the invention, the lock mechanism may include a leaf spring portion that appears in and disappears from a travel path for the projection to thereby lock the projection, and the leaf spring portion may include a convex portion that sticks out into the travel path, and that retracts from the travel path upon being contacted by the projection and returns to the sticking position upon being released from the projection.

Such a configuration allows the convex portion to be retracted by the projection upon being thereby contacted and to be restored to its initial position upon being released, thus enabling engagement and disengagement between the projection and the convex portion.

In still another aspect of the invention, the distal shaft position may be located at a position lower than the initial shaft position.

Such a configuration allows the position of the pivotal shaft to be lowered thereby increasing the inclination angle of the paper output tray to a greater degree than in the state where the pivotal shaft is at the initial shaft position, and thus extending an opening between the paper feed tray and the paper output tray at the outlet.

In still another aspect, the invention provides a recording apparatus comprising the foregoing stacking mechanism and a movable panel located above the paper output tray, wherein the lock mechanism locks the paper output tray at the predetermined angle, at a position outside a motion space of the movable panel.

Such a configuration eliminates interference between the paper output tray and the movable panel.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
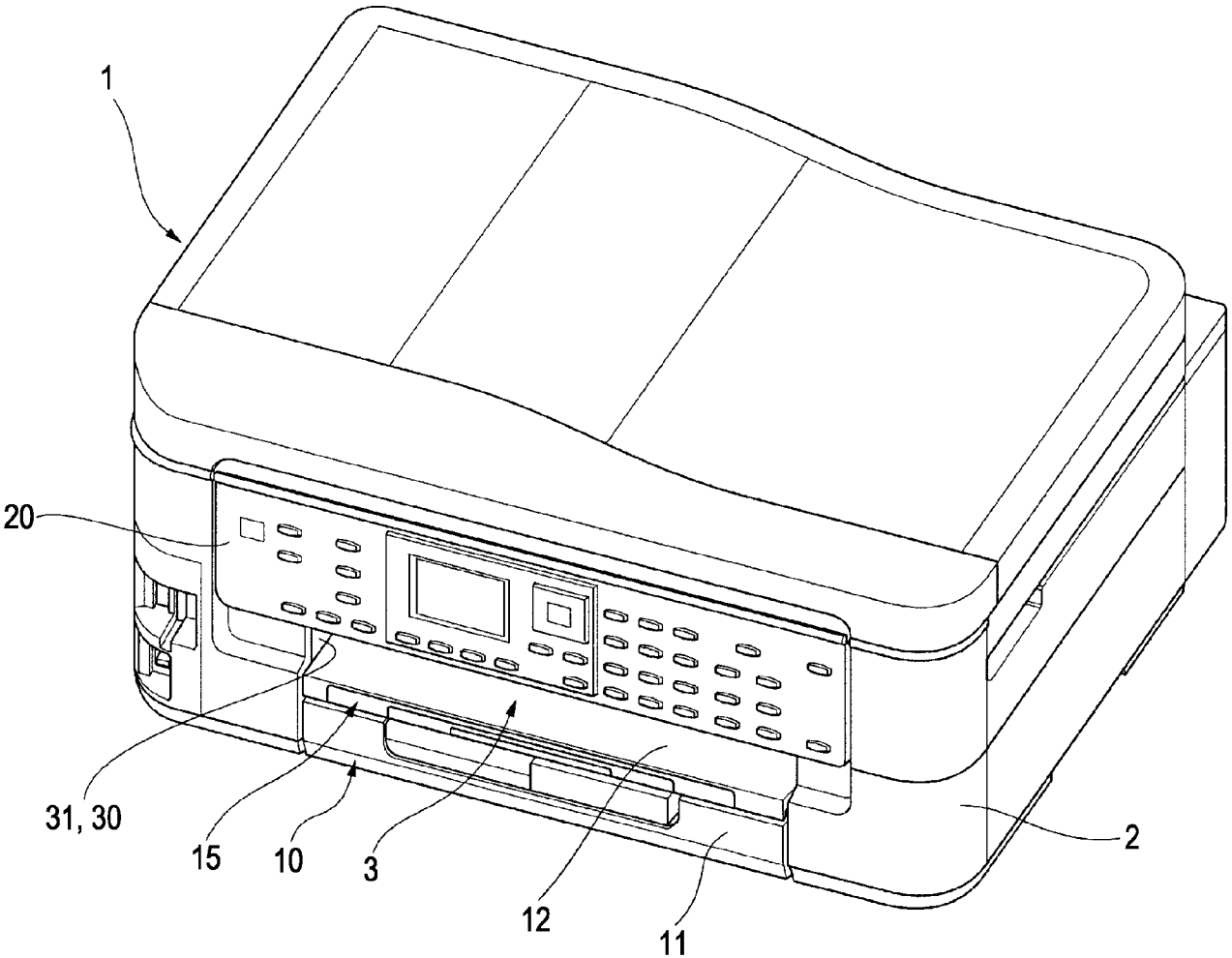
FIG. 1 is a perspective view showing an ink jet printer according to an embodiment of the invention.

Hereafter, an embodiment of a stacking mechanism and a recording apparatus according to an aspect of the invention will be described, referring to the drawings. The recording apparatus including the stacking mechanism according to the embodiment of the invention will be exemplified by an ink jet printer.

FIG. 1 is a perspective view showing the ink jet printer 1 according to the embodiment of the invention.

The ink jet printer 1 includes a stacking unit 10, in which recording paper sheets are to be stacked, and an operation panel 20 through which a user inputs predetermined information. The stacking unit 10, the recording paper, and the operation panel 20 exemplify the stacking mechanism, the recording medium, and the movable panel, respectively.

The stacking unit 10 includes a paper feed tray 11 and a paper output tray 12 superposed thereon, inside an outlet 3 formed in a housing 2. The paper feed tray 11 can be drawn out to a downstream side in a direction in which the recording paper is taken out, i.e., to a frontal area of the printer.

The operation panel 20 is located at an upper position from the stacking unit 10, and includes a tilt mechanism that allows the operation panel 20 to be displaced from a reference angle where the operation panel 20 is flush with the housing 2, to a predetermined angle.

The ink jet printer 1 picks up, upon receipt of an instruction from the operation panel 20, the recording paper sheets stacked in the paper feed tray 11 one by one; causes a recording head (not shown) provided in the housing 2 to perform scanning; and ejects ink onto the recording paper, to thereby record desired information such as characters or images. The recording paper that has undergone the recording process is discharged to the paper output tray 12 superposed on the paper feed tray 11, and stacked therein.

Referring now to FIGS. 2 to 5, the structure of the stacking unit 10 according to this embodiment will be described in further detail.

Figure 2:
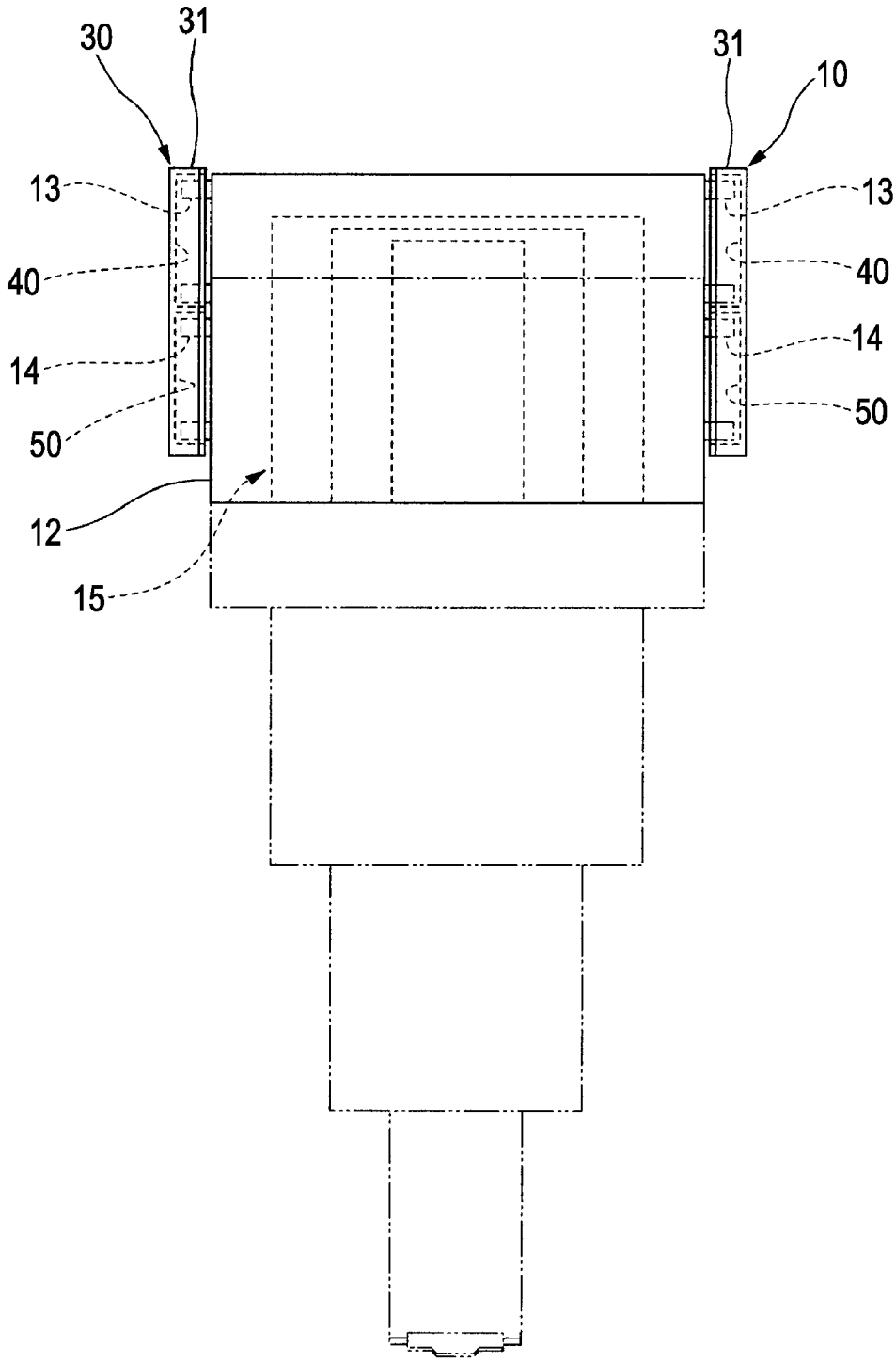
FIG. 2 is a plan view showing a paper output tray according to the embodiment of the invention.

FIG. 2 is a plan view showing the paper output tray 12 according to the embodiment of the invention.

Figure 3:
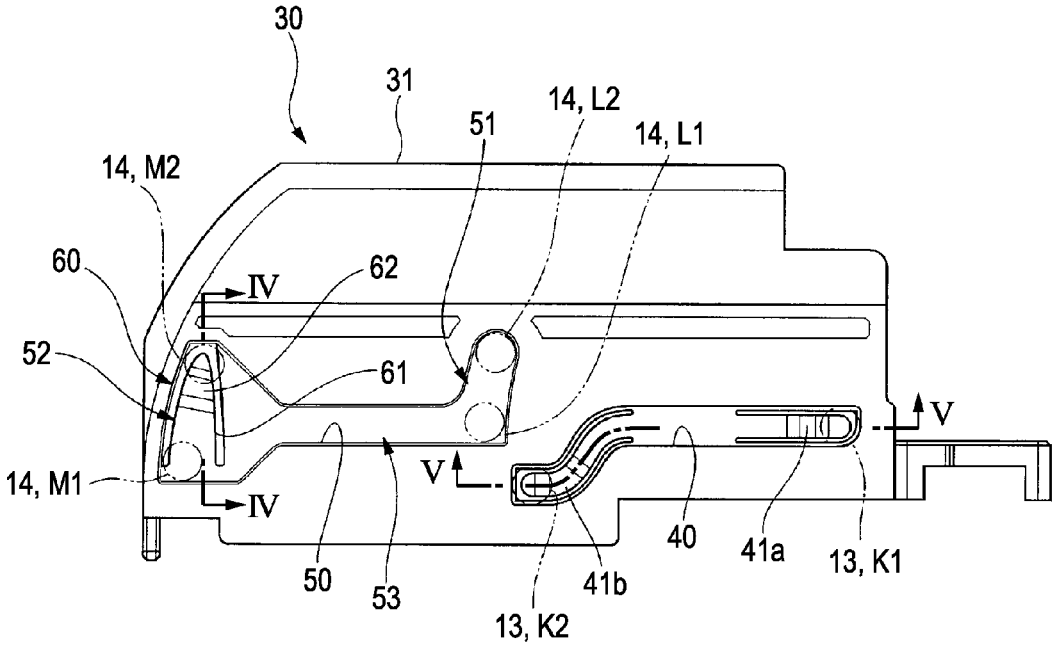
FIG. 3 is a side view showing a guide frame of a drawing mechanism according to the embodiment of the invention.

FIG. 3 is a side view showing a guide frame 31 of a drawing mechanism 30 according to the embodiment of the invention.

Figure 4:
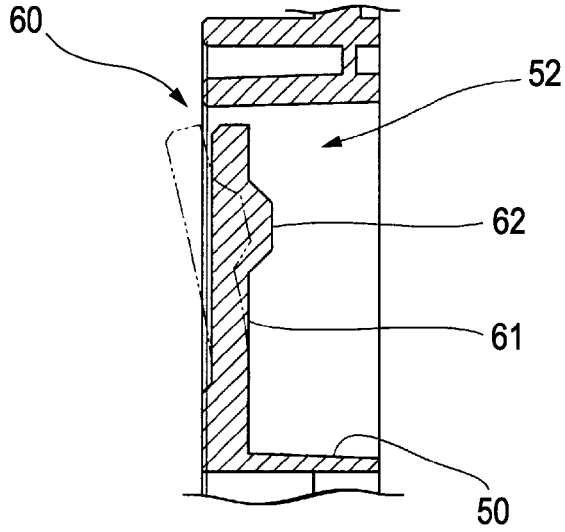
FIG. 4 is a cross-sectional view taken along a line IV-IV in FIG. 3.

FIG. 4 is a cross-sectional view taken along a line IV-IV in FIG. 3.

Figure 5:
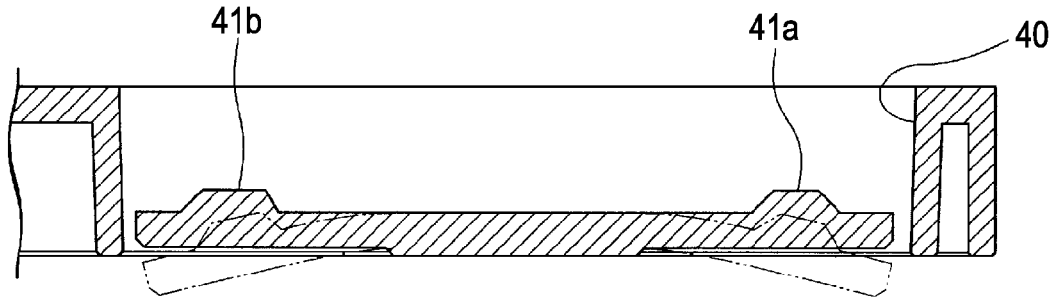
FIG. 5 is a cross-sectional view taken along a line V-V in FIG. 3.

FIG. 5 is a cross-sectional view taken along a line V-V in FIG. 3.

As shown in FIG. 2, the paper output tray 12 includes a pivotal shaft 13, located at an end portion thereof on an upstream side of the outlet 3 (upper position based on the orientation of FIG. 2) in the direction in which the paper is taken out (hereinafter, paper take-out direction) and sticking out widthwise from the respective sides. The paper output tray 12 also includes a projection 14 located at an intermediate position thereof on the downstream side of the pivotal shaft 13 (lower position in FIG. 2) in the paper take-out direction, and sticking out widthwise from the respective sides. The paper output tray 12 includes a slide mechanism 15 that allows base plates for receiving the recording paper to be extended to the downstream side.

The stacking unit 10 includes the drawing mechanism 30 that allows the paper output tray 12 to be drawn out through the outlet 3. The drawing mechanism 30 includes a pair of guide frames 31 that support the pivotal shaft 13 and the projection 14 of the paper output tray 12 on the respective widthwise sides. The pair of guide frames 31 are disposed so as to constitute the respective side walls of the outlet 3. Each guide frame 31 includes a first guide groove 40 that supports the pivotal shaft 13 and guides the movement thereof in the paper take-out direction, and a second guide groove 50 that supports the projection 14 and guides the movement thereof in the paper take-out direction.

As shown in FIG. 3, the first guide groove 40 and the second guide groove 50 are independently disposed with respect to each other, such that the first guide groove 40 is located on the upstream side in the paper take-out direction (on the right in FIG. 3), and the second guide groove 50 is located on the downstream side of the first guide groove 40 in the paper take-out direction (on the left in FIG. 3). The first guide groove 40 and the second guide groove 50 provide the same slide stroke in the paper take-out direction (left-and-right direction in FIG. 3).

The first guide groove 40 is formed between an initial shaft position K1 where the pivotal shaft 13 is located when the paper output tray 12 is in the initial position and a distal shaft position K2 where the pivotal shaft 13 is located when the paper output tray 12 is drawn out. The distal shaft position K2 is located at a lower position from the initial shaft position K1. The first guide groove 40 constitutes a travel path for the pivotal shaft 13, horizontally extending from the initial shaft position K1 to the downstream side in the paper take-out direction, inclined downward at an intermediate portion, and again horizontally extending to the distal shaft position K2.

The second guide groove 50 includes a first pivotal groove 51 that pivotally guides the projection 14 when the pivotal shaft 13 is at the initial shaft position K1, a second pivotal groove 52 that pivotally guides the projection 14 when the pivotal shaft 13 is at the distal shaft position K2, and a connection groove 53 extending in the paper take-out direction so as to connect the first pivotal groove 51 and the second pivotal groove 52.

The first pivotal groove 51 is formed between a first initial projection position L1 where the projection 14 is located when the pivotal shaft 13 is at the initial shaft position K1 and a second initial projection position L2 located above the first initial projection position L1 when the paper output tray 12 is in the initial position. The first pivotal groove 51 constitutes an arcuate travel path for the projection 14 about the initial shaft position K1, between the first initial projection position L1 and the second initial projection position L2. The first pivotal groove 51 allows, when the paper output tray 12 is in the initial position, the paper output tray 12 to pivot about the pivotal shaft 13 located at the initial shaft position K1, in a range between the first initial projection position L1 and the second initial projection position L2, to thereby change the angle.

The second pivotal groove 52 is formed between a first distal projection position M1 where the projection 14 is located when the pivotal shaft 13 is at the distal shaft position K2, and a second distal projection position M2 located above the first distal projection position M1 when the paper output tray 12 is drawn out. The second pivotal groove 52 constitutes an arcuate travel path for the projection 14 about the distal shaft position K2, between the first distal projection position M1 and the second distal projection position M2. The second pivotal groove 52 allows, when the paper output tray 12 is drawn out, the paper output tray 12 to pivot about the pivotal shaft 13 located at the distal shaft position K2, in a range between the first distal projection position M1 and the second distal projection position M2, to thereby change the angle.

The connection groove 53 horizontally extends from the position corresponding to the first initial projection position L1 of the first pivotal groove 51 to the downstream side in the paper take-out direction, so as to connect the first pivotal groove 51 and the second pivotal groove 52. The connection groove 53 is connected to the second pivotal groove 52 at an intermediate position between the first distal projection position M1 and the second distal projection position M2. Also, the connection groove 53 has an increasing width from the connection point with the second pivotal groove 52 toward the downstream side in the paper take-out direction, thus constituting an inclined travel path for the projection 14, leading to the first distal projection position M1 and to the second distal projection position M2.

In the second pivotal groove 52, a lock mechanism 60 is provided that locks the paper output tray 12 displaced about the pivotal shaft 13, at a predetermined angle. The lock mechanism 60 includes a leaf spring portion 61 that supports a lower portion of the projection 14 of the paper output tray 12 to thereby lock the projection 14, at the position corresponding to the second distal projection position M2. In this embodiment, the leaf spring portion 61 is formed by cutting out a portion of the guide frame 31 (made of a resin material in this embodiment), so that the elasticity of the material serves to lock the projection 14 at the second distal projection position M2. The leaf spring portion 61 is formed along the second pivotal groove 52, such that a portion close to the first distal projection position M1 constitutes a base portion, and that a portion close to the second distal projection position M2 constitutes a tip portion.

As shown in FIG. 4, the leaf spring portion 61 includes a convex portion 62 formed in a distal portion thereof. The convex portion 62 usually sticks out into the travel path for the projection 14. The convex portion 62 is retracted from the travel path for the projection 14 upon being contacted thereby, and returns from the retracted position (indicated by two-dot chain lines in FIG. 4) to the sticking out position (indicated by solid lines in FIG. 4), upon being released from the projection 14. To be more detailed, when the projection 14 enters into contact with the convex portion 62, the distal portion of the leaf spring portion 61 is deflected about the base portion depthwise of the second pivotal groove 52, against the elastic force of the leaf spring portion 61. Then when the convex portion 62 is released from the projection 14, the elastic force restores the distal portion of the leaf spring portion 61 to its initial posture, so that the convex portion 62 returns to the travel path for the projection 14. Once the convex portion 62 returns to the travel path for the projection 14, the convex portion 62 serves to support the lower portion of the projection 14, to thereby lock the paper output tray 12 at the predetermined angle. The convex portion 62 according to this embodiment has a generally trapezoidal cross-sectional shape as shown in FIG. 4, which provides a slope along the travel path for the projection 14 for smooth retraction and restoration of the convex portion 62.

Further, as shown in FIGS. 3 and 5, the first guide groove 40 includes a leaf spring portion 41*a* that locks the pivotal shaft 13 at the initial shaft position K1, and a leaf spring portion 41*b* that locks the pivotal shaft 13 at the distal shaft position K2. The leaf spring portions 41*a*, 41*b* provided in the first guide groove 40 are formed similarly to the leaf spring portion 61 in the second pivotal groove 52, and can retract from or stick out into the travel path for the pivotal shaft 13, to thereby serve to lock the pivotal shaft 13 at the initial shaft position K1 or the distal shaft position K2.

Referring now to FIGS. 6 to 11, description will be given on operation and advantages of the stacking unit 10 configured as above.

Figure 6:
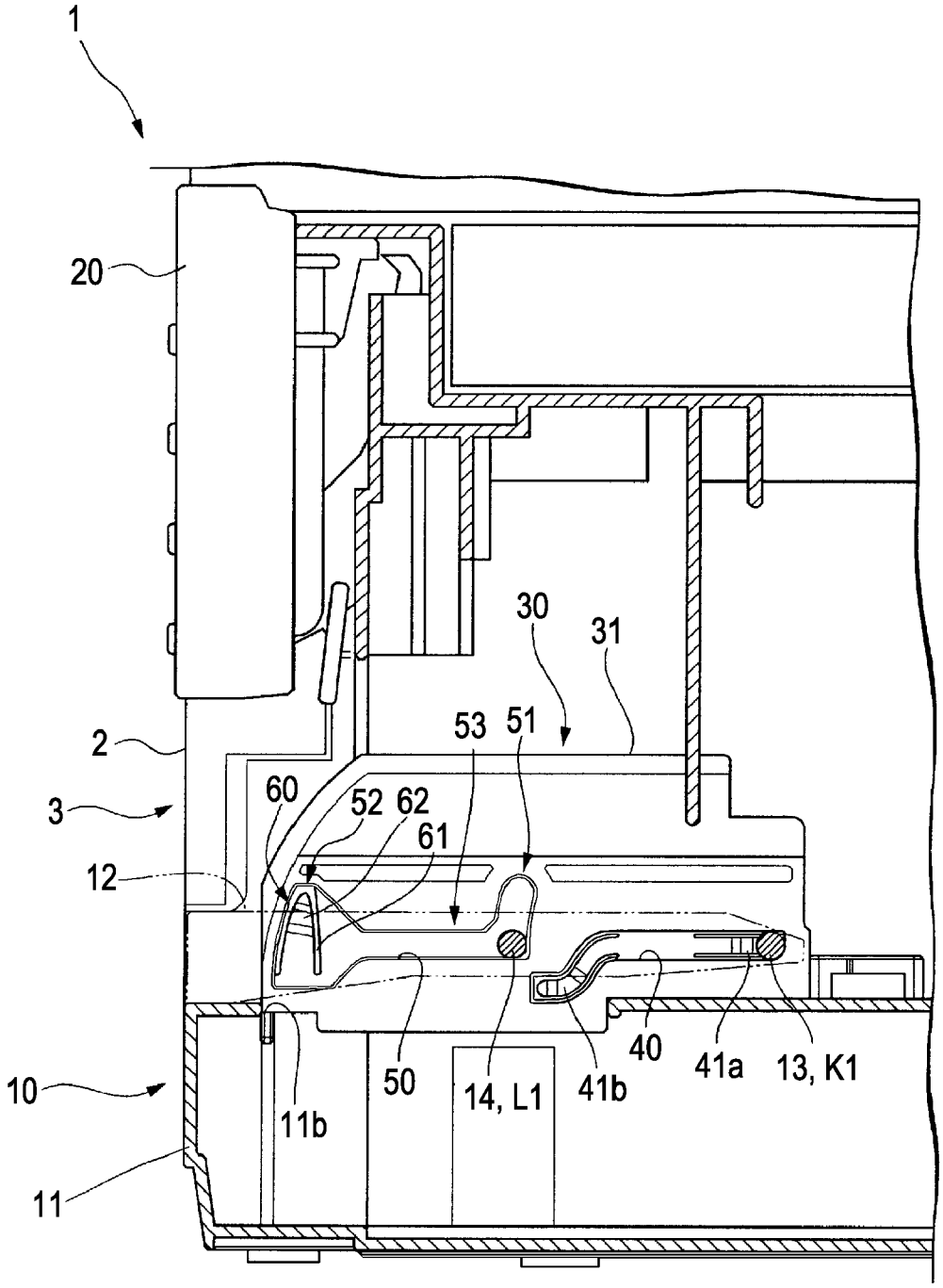
FIG. 6 is a side sectional view showing a stacking unit according to the embodiment of the invention, in a state where a pivotal shaft is located at an initial shaft position and a projection is located at a first initial projection position.

FIG. 6 is a side sectional view showing the stacking unit 10 according to the embodiment of the invention, in a state where the pivotal shaft 13 is located at the initial shaft position K1 and the projection 14 is located at the first initial projection position L1.

Figure 7:
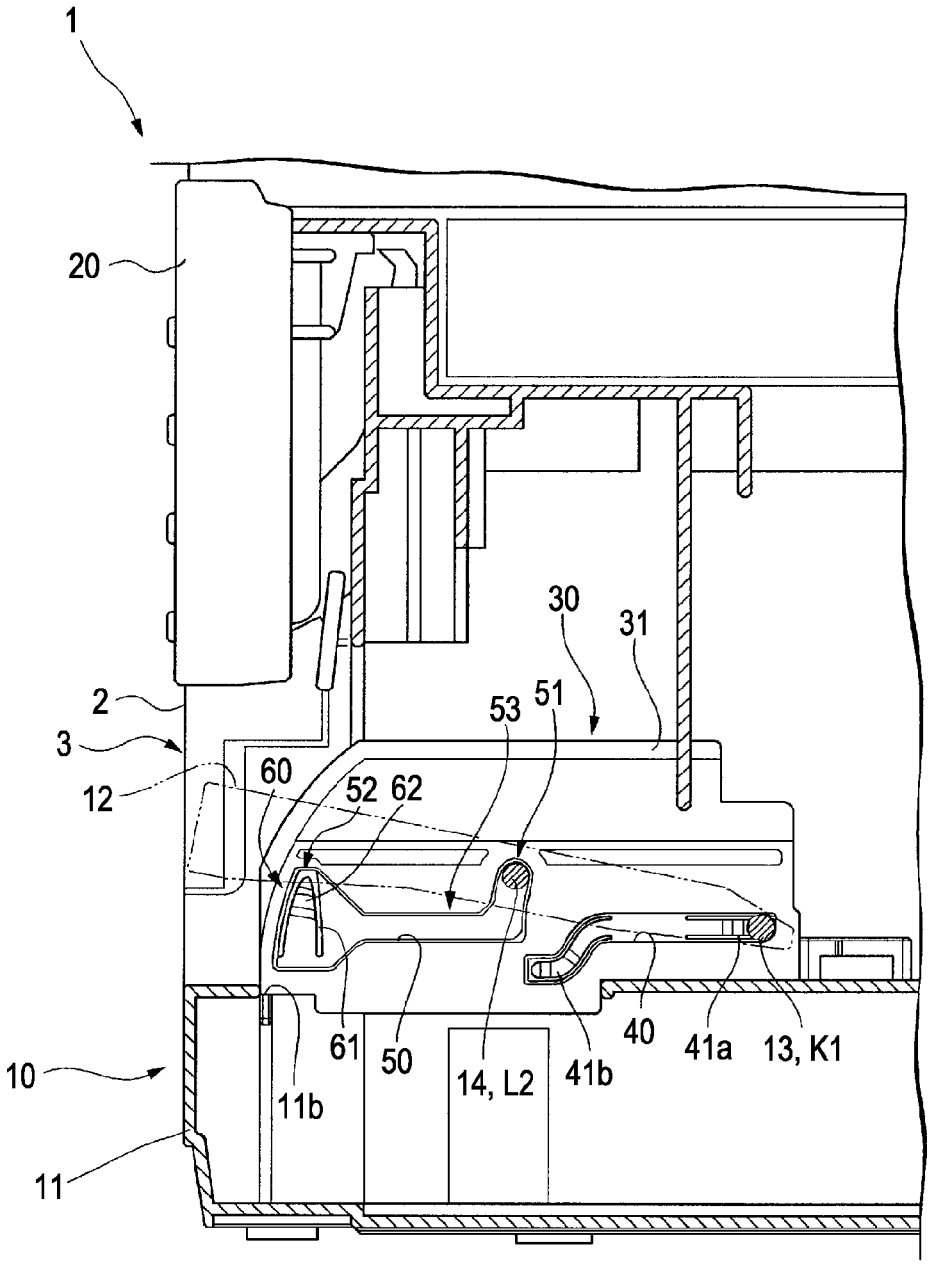
FIG. 7 is a side sectional view showing the stacking unit according to the embodiment of the invention, in a state where the pivotal shaft is located at the initial shaft position and the projection is located at a second initial projection position.

FIG. 7 is a side sectional view showing the stacking unit 10 according to the embodiment of the invention, in a state where the pivotal shaft 13 is located at the initial shaft position K1 and the projection 14 is located at the second initial projection position L2.

Figure 8:
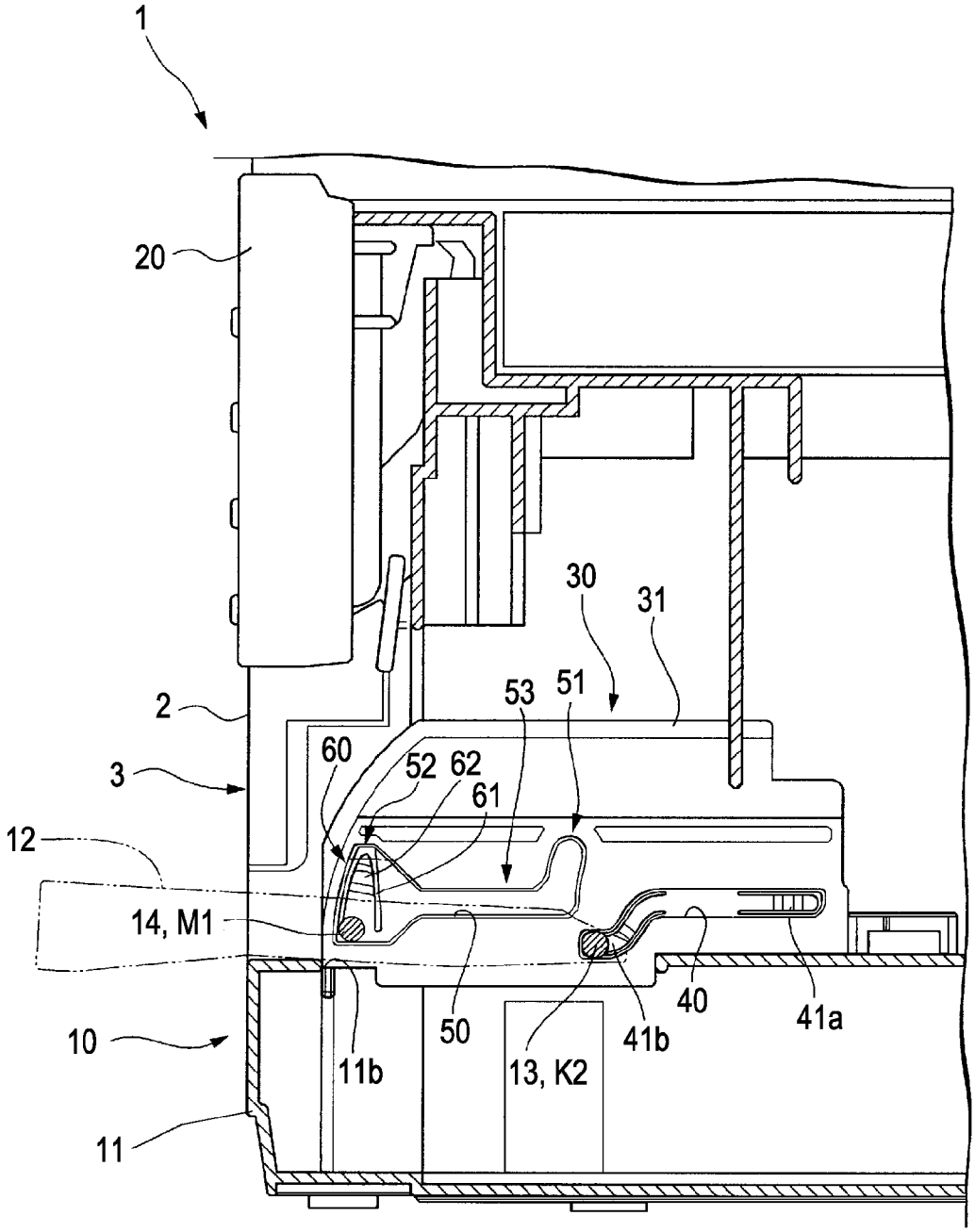
FIG. 8 is a side sectional view showing the stacking unit according to the embodiment of the invention, in a state where the pivotal shaft is located at a distal shaft position and the projection is located at a first distal projection position.

FIG. 8 is a side sectional view showing the stacking unit 10 according to the embodiment of the invention, in a state where the pivotal shaft 13 is located at the distal shaft position K2 and the projection 14 is located at the first distal projection position M1.

Figure 9:
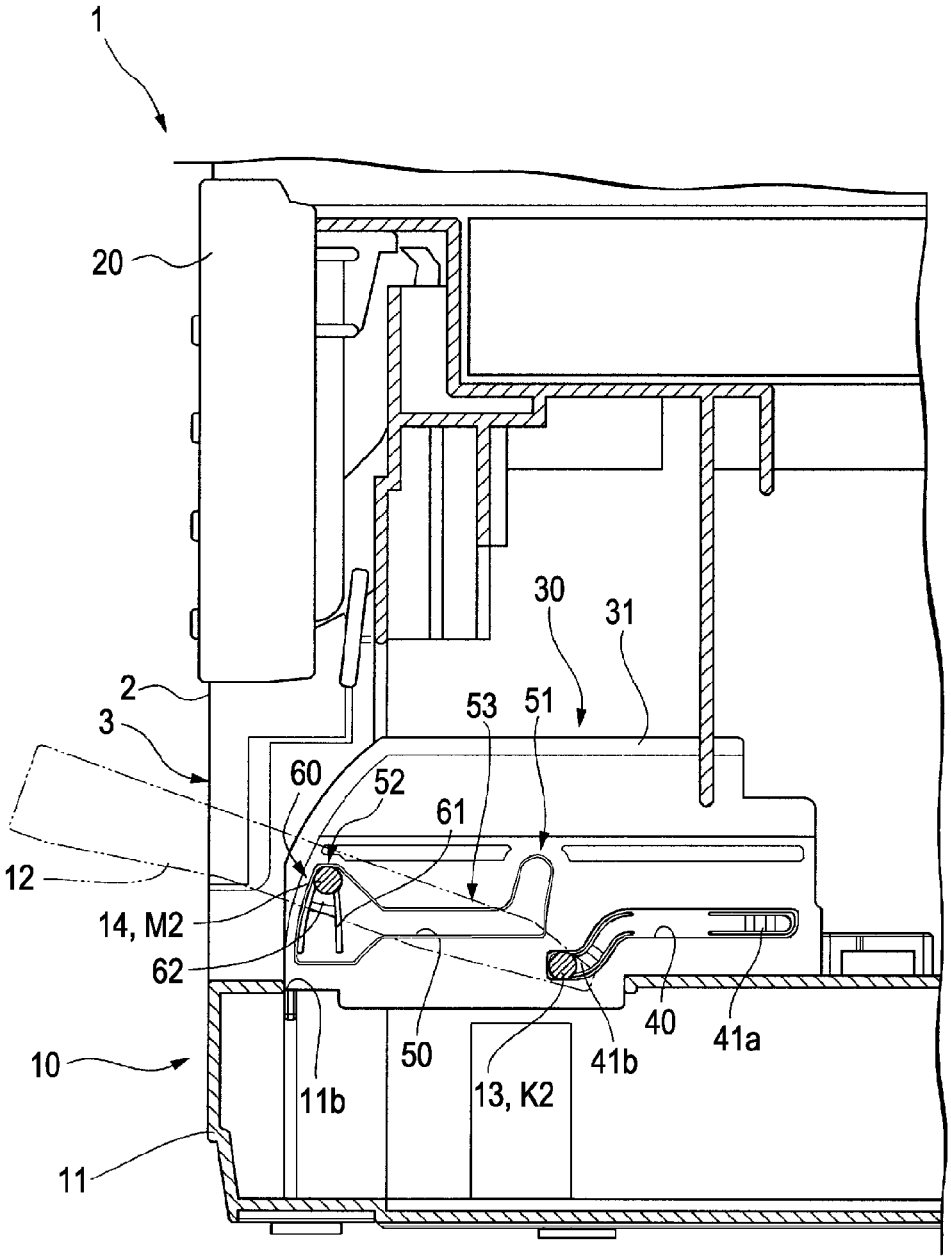
FIG. 9 is a side sectional view showing the stacking unit according to the embodiment of the invention, in a state where the pivotal shaft is located at the distal shaft position and the projection is located at a second distal projection position.

FIG. 9 is a side sectional view showing the stacking unit 10 according to the embodiment of the invention, in a state where the pivotal shaft 13 is located at the distal shaft position K2 and the projection 14 is located at the second distal projection position M2.

Figure 10:
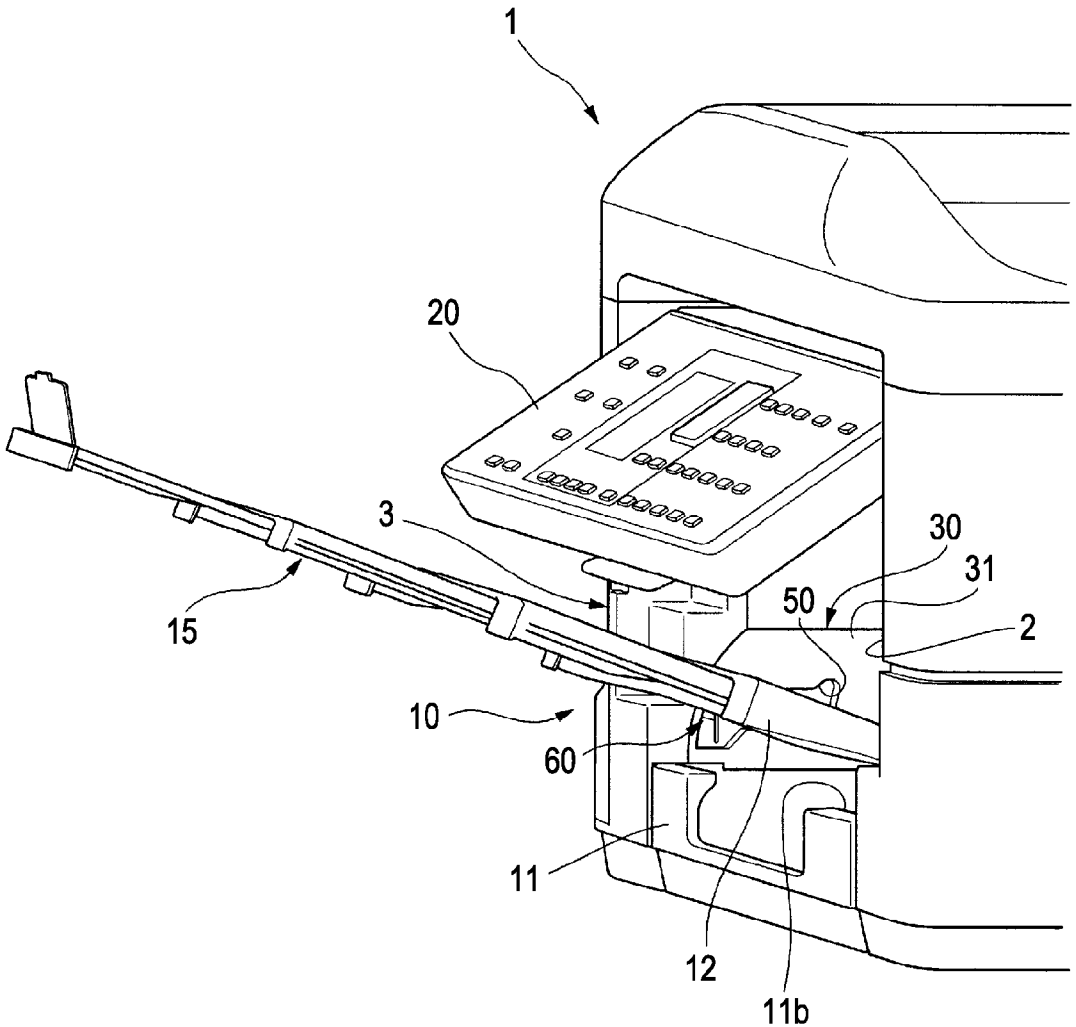
FIG. 10 is a perspective view showing a positional relationship between the paper output tray and an operation panel, when a slide mechanism is extended in the state shown in FIG. 9.

FIG. 10 is a perspective view showing a positional relationship between the paper output tray 12 and the operation panel 20, when the slide mechanism 15 is extended in the state shown in FIG. 9.

Figure 11:
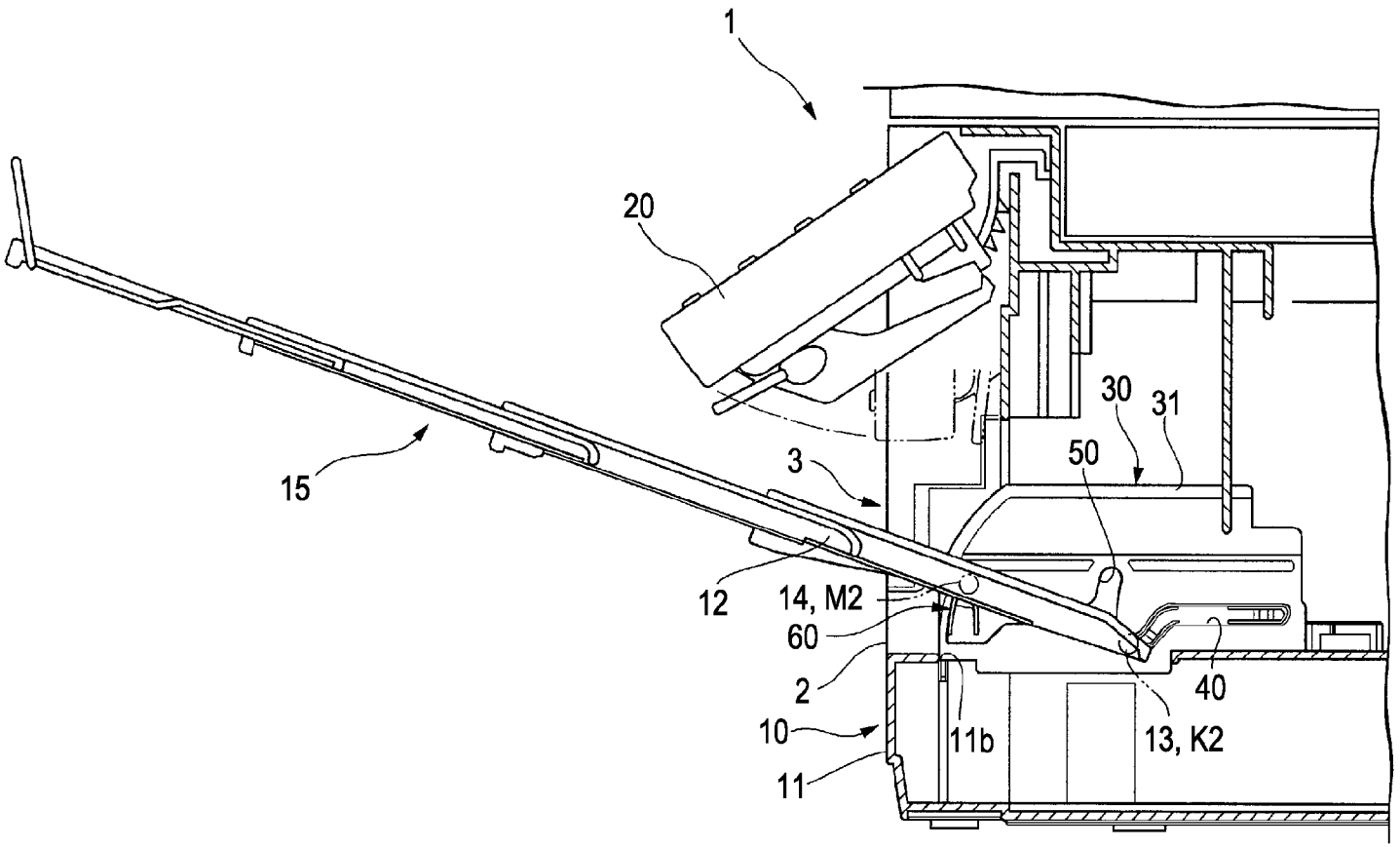
FIG. 11 is a side sectional view showing a positional relationship between the paper output tray and an operation panel, when a slide mechanism is extended in the state shown in FIG. 9.

FIG. 11 is a side sectional view showing a positional relationship between the paper output tray 12 and the operation panel 20, when the slide mechanism 15 is extended in the state shown in FIG. 9.

As shown in FIG. 6, the paper output tray 12 closes a paper inlet 11*b* of the paper feed tray 11, which is vertically open inside the outlet 3, when the pivotal shaft 13 is at the initial shaft position K1 and the projection 14 is at the first initial projection position L1. In such state, the paper output tray 12 is oriented such that the face for receiving the recording paper is horizontal, and the end portion of the paper output tray 12 on the downstream side in the paper take-out direction becomes flush with the front face of the housing 2 including the outlet 3, as well as with the end portion of the paper feed tray 11 on the downstream side in the paper take-out direction.

As shown in FIG. 7, the paper output tray 12 opens the paper inlet 11*b* of the paper feed tray 11, when the pivotal shaft 13 is at the initial shaft position K1 and the projection 14 is at the second initial projection position L2.

When the paper output tray 12 is in the initial position, the pivotal shaft 13 is pivotally locked by the leaf spring portion 41*a*, at the initial shaft position K1 in the first guide groove 40. Accordingly, the paper output tray 12 can be angularly displaced with respect to the paper inlet 11*b*, by moving the projection 14 along the first pivotal groove 51 about the pivotal shaft 13 on the upstream side in the paper take-out direction. Pivoting the paper output tray 12 about the pivotal shaft 13 on the upstream side in the paper take-out direction results in an opening being provided between the paper feed tray 11 and the paper output tray 12 at the outlet 3, thereby opening the paper inlet 11*b* as shown in FIG. 7. Such a configuration allows the user to visually check or refill the recording paper, without drawing out the paper feed tray 11.

Here, locking the paper output tray 12 in the initial position but inclined as shown in FIG. 7 would restrict the area for receiving the discharged paper, and hence if the printed recording paper were discharged in this state the recording paper might fail in being properly stacked, resulting in a paper jam. In this embodiment, therefore, the lock mechanism is not provided in the first pivotal groove 51, with respect to the pivoting motion of the paper output tray 12.

As shown in FIG. 8, the paper output tray 12 closes the paper inlet 11*b* of the paper feed tray 11, when the pivotal shaft 13 is at the distal shaft position K2 and the projection 14 is at the first distal projection position M1. In such state, the face of the paper output tray 12 for receiving the recording paper is slightly slanted with respect to a horizontal plane, and the end portion of the paper output tray 12 on the downstream side in the paper take-out direction sticks out forward from the front face of the housing 2 including the outlet 3. During the printing operation, the user draws out the paper output tray 12 and extends the slide mechanism 15 (FIG. 2), to thereby extend the face for receiving the recording paper to the downstream side in the paper take-out direction, for stacking thereon the recording paper that has undergone the printing process.

As shown in FIG. 9, the paper output tray 12 opens the paper inlet 11*b* of the paper feed tray 11, when the pivotal shaft 13 is at the distal shaft position K2 and the projection 14 is at the second distal projection position M2.

When the paper output tray 12 is drawn out, the pivotal shaft 13 is pivotally locked by the leaf spring portion 41*b*, at the distal shaft position K2 in the first guide groove 40. Accordingly, the paper output tray 12 can be angularly displaced with respect to the paper inlet 11*b*, by moving the projection 14 along the second pivotal groove 52 about the pivotal shaft 13 on the upstream side in the paper take-out direction. Pivoting the paper output tray 12 about the pivotal shaft 13 on the upstream side in the paper take-out direction results in an opening being provided between the paper feed tray 11 and the paper output tray 12 at the outlet 3, thereby opening the paper inlet 11*b* as shown in FIG. 9.

While the projection 14 moves along the second pivotal groove 52 from the first distal projection position M1 to the second distal projection position M2, the convex portion 62 of the leaf spring portion 61 sticking out into the travel path for the projection 14 is retracted upon being contacted by the projection 14, and returns to the sticking position upon being released therefrom, to thereby lock the projection 14 at the second distal projection position M2. Thus, the paper output tray 12 is retained at the predetermined angle.

When the paper output tray 12 is retained at the predetermined angle, the paper output tray 12 is prevented from dropping due to its own weight, thereby facilitating access to the pull portion of the paper feed tray 11 by the user. Also, since the distal shaft position K2 is at a lower position than the initial shaft position K1, the paper output tray 12 can be inclined by a larger angle than in the state shown in FIG. 7, which provides a larger opening between the paper feed tray 11 and the paper output tray 12. Such a configuration further facilitates access to the pull portion of the paper feed tray 11 by the user.

It is to be noted that retaining the paper output tray 12 drawn out as shown in FIG. 9 provides a larger area for receiving the recording paper than in the state shown in FIG. 7, and hence discharging the printed recording paper in this state does not result in a paper jam.

Referring further to FIGS. 10 and 11, designing the lock mechanism 60 so as to lock the paper output tray 12 at the predetermined angle at a position outside the motion space of the operation panel 20 allows interference to be prevented between the paper output tray 12 and the operation panel 20, even when the slide mechanism 15 of the paper output tray 12 is extended in the state shown in FIG. 9.

Thus, the foregoing embodiment represents the stacking unit 10 including the paper feed tray 11 and the paper output tray 12 superposed thereon inside the outlet 3 through which the recording paper is taken out. The paper output tray 12 includes the pivotal shaft 13 that allows angular displacement of the paper outlet tray 12 with respect to the paper inlet 11*b* of the paper feed tray 11, on the upstream side of the outlet 3 in the paper take-out direction, and the stacking unit 10 includes the lock mechanism 60 that locks the paper output tray 12 pivoted about the pivotal shaft 13 at the predetermined angle. Such a configuration contributes to improving the work efficiency in refilling the recording paper.

Although the preferred embodiment of the invention has been described above, it is to be understood that the invention is in no way limited to the foregoing embodiment. The shapes and combination of the constituents of the embodiment are merely exemplary, and may be modified in various manners according to designing requirements and so forth, within the scope and spirit of the invention.

For example, although the lock mechanism according to the embodiment is configured to lock the paper output tray at a single position, the lock mechanism may be designed to lock the paper output tray at a plurality of positions.

Also, although the recording apparatus is exemplified by an ink jet printer in the embodiment, the invention is also applicable to a copier, a facsimile machine, or the like, in addition to an ink jet printer.

What is claimed is:

1. A stacking mechanism comprising:

a paper feed tray including a paper inlet through which a recording medium to undergo a recording process is to be supplied;

a paper output tray on which the recording medium that has undergone the recording process and been transported is to be stacked, the paper output tray being superposed on the paper feed tray;

a pivotal shaft that allows the paper output tray to pivot with respect to the paper feed tray so as to expose the paper inlet of the paper feed tray;

a lock mechanism that locks the paper output tray displaced about the pivotal shaft, at a predetermined position; and a drawing mechanism that allows the paper output tray to be drawn out in a transport direction of the recording medium;

wherein the lock mechanism locks the paper output tray drawn out, at the predetermined position angle, the paper output tray includes a projection provided on a downstream side of the pivotal shaft in the recording medium transport direction, the drawing mechanism includes a first guide groove that guides the pivotal shaft and a second guide groove that guides the projection;

the first guide groove is provided between an initial shaft position where the pivotal shaft is located where the paper output tray is set in an initial position, and a distal shaft position, on the downstream side in the direction in which the recording medium is taken out, where the pivotal shaft is located when the paper output tray is drawn out;

the second guide groove includes a first pivotal groove that pivotally guides the projection between a first initial projection position where the projection is located where the pivotal shaft is at the initial shaft position and a second initial projection position located above the first initial projection position, a second pivotal groove that pivotally guides the projection between the first distal projection position where the projection is located where the pivotal shaft is at the distal shaft position and a second distal projection position located above the first distal projection position, and a connection groove extending in the direction in which the recording medium is taken out so as to connect the first pivotal groove and the second pivotal groove, wherein the lock mechanism is provided in the second pivotal groove and the lock mechanism is located at a position corresponding to the second distal projection position, wherein the lock mechanism includes a leaf spring portion that appears in and disappears from a travel path for the projection to thereby lock the projection; and the leaf spring portion includes a convex portion that sticks out into the travel path, and that retracts from the travel path upon being contacted by the projection and returns to the sticking out position upon being released from the projection.

2. The stacking mechanism according to claim 1, wherein the distal shaft position is located at a position lower than the initial shaft position.

3. A recording apparatus comprising:

the stacking mechanism according to claim 1; and a movable panel located above the paper output tray;

wherein the lock mechanism locks the paper output tray at the predetermined position, in a region outside a motion space of the movable panel.

* * * * *